US010748466B2

(12) United States Patent
Zeng

(10) Patent No.: US 10,748,466 B2
(45) Date of Patent: Aug. 18, 2020

(54) DISPLAY PANEL AND METHOD OF DRIVING THE SAME

(71) Applicant: Wuhan China Star Optoelectronics Semiconductor Display Technology Co., Ltd., Wuhan (CN)

(72) Inventor: Mian Zeng, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/318,134

(22) PCT Filed: Nov. 16, 2018

(86) PCT No.: PCT/CN2018/115934
§ 371 (c)(1),
(2) Date: Jan. 16, 2019

(87) PCT Pub. No.: WO2020/056900
PCT Pub. Date: Mar. 26, 2020

(65) Prior Publication Data

US 2020/0098299 A1 Mar. 26, 2020

(30) Foreign Application Priority Data

Sep. 20, 2018 (CN) ..... 2018 1 11005007

(51) Int. Cl.
*G09G 3/20* (2006.01)

(52) U.S. Cl.
CPC ... *G09G 3/2003* (2013.01); *G09G 2300/0452* (2013.01); *G09G 2310/0297* (2013.01); *G09G 2330/021* (2013.01)

(58) Field of Classification Search
CPC combination set(s) only.
See application file for complete search history.

(56) References Cited

U.S. PATENT DOCUMENTS 6,023,315 A * 2/2000 Harrold ..... G02B 27/2214 349/108
6,624,828 B1 * 9/2003 Dresevic ..... G06F 1/1607 345/594
2004/0044893 A1 * 3/2004 Alattar ..... G06T 1/0028 713/176
2008/0079748 A1 * 4/2008 Phan ..... G09G 3/2003 345/589

(Continued)

FOREIGN PATENT DOCUMENTS

CN 204516287 7/2015
CN 105810143 7/2016

(Continued)

*Primary Examiner* — Van N Chow

(57) ABSTRACT

A display panel and a method of driving the display panel are proposed. The display panel includes a pixel array, a data driving circuit comprising one or more data line, a scanning driving circuit, and a demultiplexing circuit. The scanning driving circuit and the demultiplexing circuit both are configured to input a data signal through the data line into the first subpixel, the second subpixel, the fourth subpixel, and the third subpixel sequentially. The present disclosure can reduce power consumption of the display panel.

18 Claims, 3 Drawing Sheets

(56) References Cited

U.S. PATENT DOCUMENTS

| | | | | |
|---|---|---|---|---|
| 2012/0146172 | A1* | 6/2012 | Carey | H01L 31/103 257/443 |
| 2012/0281025 | A1* | 11/2012 | Hanamoto | G09G 3/3413 345/690 |
| 2016/0322008 | A1 | 11/2016 | Sang et al. | |
| 2017/0372662 | A1 | 12/2017 | Zhang et al. | |
| 2018/0151137 | A1* | 5/2018 | Lee | G09G 3/3659 |
| 2018/0151145 | A1* | 5/2018 | Lee | G09G 3/3614 |
| 2019/0005902 | A1* | 1/2019 | Chen | G09G 3/3607 |
| 2019/0141238 | A1* | 5/2019 | Zhou | H04N 5/332 |
| 2019/0156768 | A1 | 5/2019 | Xing et al. | |

FOREIGN PATENT DOCUMENTS

| | | |
|---|---|---|
| CN | 106292096 | 1/2017 |
| CN | 106531096 | 3/2017 |
| CN | 107146588 | 9/2017 |

* cited by examiner

DISPLAY PANEL AND METHOD OF DRIVING THE SAME

RELATED APPLICATIONS

This application is a National Phase of PCT Patent Application No. PCT/CN2018/115934 having International filing date of Nov. 16, 2018, which claims the benefit of priority of Chinese Patent Application No. 201811100500.7 filed on Sep. 20, 2018. The contents of the above applications are all incorporated by reference as if fully set forth herein in their entirety.

FIELD AND BACKGROUND OF THE INVENTION

The present disclosure relates to display technology, and more particularly, to a display panel and a method of driving the display panel.

Generally, a display panel of the related art is provided with a demultiplexing circuit to reduce the size of a data driving circuit (Source IC).

The applicants of the present disclosure have found out a problem and drawback related to the related art as follows.

When a demultiplexing circuit in a display panel of the related art is in an operating state, a signal with higher frequency is inevitable. Accordingly, power consumption of the display panel is greater.

Therefore, it is necessary to propose a new technical solution to solve the technical problem as mentioned above.

SUMMARY OF THE INVENTION

An object of the present disclosure is to provide a display panel and a method of driving the display panel. According to the present disclosure, power consumption of the display panel can be reduced.

According to a first aspect of the present disclosure, a display panel includes a pixel array, comprising a first pixel row and a second pixel row; the first pixel row comprising one or more first subpixel and second subpixel; the second pixel row comprising one or more third subpixel and fourth subpixel; the first subpixel and the third subpixel both being in a first pixel column; the second subpixel and the fourth subpixel both being in a second pixel column; color corresponding to the second subpixel being the same as the color corresponding to the fourth subpixel; a data driving circuit, comprising one or more data line; a scanning driving circuit; a demultiplexing circuit. The scanning driving circuit and the demultiplexing circuit both are configured to input a data signal through the data line into the first subpixel, the second subpixel, the fourth subpixel, and the third subpixel sequentially. A first pixel switch of the first subpixel and a second pixel switch of the second subpixel are turned on or off simultaneously; a third pixel switch of the third subpixel and a fourth pixel switch of the fourth subpixel are turned on or off simultaneously. When the first pixel switch is turned on, the third pixel switch is turned off. When the first pixel switch is turned off, the third pixel switch is turned on. When the second pixel switch is turned on, the fourth pixel switch is turned off; when the second pixel switch is turned off, the fourth pixel switch is turned on. The color corresponding to the first subpixel is either red or blue but different from the color corresponding to the third subpixel. The color corresponding to the third subpixel is either red or blue but different from the color corresponding to the first subpixel. The second subpixel and the fourth subpixel both are green.

According an embodiment of the present disclosure, the time when the first pixel switch is turned on is separated from the time when the third pixel switch is turned on by a first time interval; the time when the first pixel switch is turned off is separated from the time when the third pixel switch is turned off by a second time interval; the time when the second pixel switch is turned on is separated from the time when the fourth pixel switch is turned on by a third time interval; the time when the second pixel switch is turned off is separated from the time when the fourth pixel switch is turned off by a fourth time interval. The first time interval, the second time interval, the third time interval, and the fourth time interval are all equal.

According an embodiment of the present disclosure, the data driving circuit further comprises a first sub-data line and a second sub-data line; the scanning driving circuit comprises one or more first scanning line and second scanning line; the demultiplexing circuit is connected to the data line, the first sub-data line, and the second sub-data line; the demultiplexing circuit comprises one or more first controlling switch, second controlling switch, first controlling line, and second controlling line; when the first controlling switch is turned on, the second controlling switch is turned off; when the first controlling switch is turned off, the second controlling switch is turned on.

According to a second aspect of the present disclosure, a display panel includes: a pixel array, comprising a first pixel row and a second pixel row; the first pixel row comprising one or more first subpixel and second subpixel; the second pixel row comprising one or more third subpixel and fourth subpixel; the first subpixel and the third subpixel both being in a first pixel column; the second subpixel and the fourth subpixel both being in a second pixel column; color corresponding to the second subpixel being the same as the color corresponding to the fourth subpixel; a data driving circuit, comprising one or more data line; a scanning driving circuit; a demultiplexing circuit. The scanning driving circuit and the demultiplexing circuit both are configured to input a data signal through the data line into the first subpixel, the second subpixel, the fourth subpixel, and the third subpixel sequentially.

According an embodiment of the present disclosure, a first pixel switch of the first subpixel and a second pixel switch of the second subpixel are turned on or off simultaneously; a third pixel switch of the third subpixel and a fourth pixel switch of the fourth subpixel are turned on or off simultaneously. When the first pixel switch is turned on, the third pixel switch is turned off. When the first pixel switch is turned off, the third pixel switch is turned on. When the second pixel switch is turned on, the fourth pixel switch is turned off. When the second pixel switch is turned off, the fourth pixel switch is turned on;

According an embodiment of the present disclosure, the time when the first pixel switch is turned on is separated from the time when the third pixel switch is turned on by a first time interval; the time when the first pixel switch is turned off is separated from the time when the third pixel switch is turned off by a second time interval; the time when the second pixel switch is turned on is separated from the time when the fourth pixel switch is turned on by a third time interval; the time when the second pixel switch is turned off is separated from the time when the fourth pixel switch is turned off by a fourth time interval. The first time interval, the second time interval, the third time interval, and the fourth time interval are all equal.

According an embodiment of the present disclosure, the data driving circuit further comprises a first sub-data line and a second sub-data line; the scanning driving circuit comprises one or more first scanning line and second scanning line; the demultiplexing circuit is connected to the data line, the first sub-data line, and the second sub-data line; the demultiplexing circuit comprises one or more first controlling switch, second controlling switch, first controlling line, and second controlling line; when the first controlling switch is turned on, the second controlling switch is turned off; when the first controlling switch is turned off, the second controlling switch is turned on.

According an embodiment of the present disclosure, the first controlling switch and the second controlling switch both are transistors. The first controlling switch and the second controlling switch are disposed on one side of the pixel array.

According an embodiment of the present disclosure, the first sub-data line and the second sub-data line are connected to the first pixel column and the second pixel column, respectively. The demultiplexing circuit is configured to turn on or off a first current channel between the data line and the first sub-data line, and control to turn on or off a second current channel between the data line and the second sub-data line.

According an embodiment of the present disclosure, the first controlling switch comprises a first inputting terminal, a first outputting terminal, and a first controlling terminal; the second controlling switch comprises a second inputting terminal, a second outputting terminal, and a second controlling terminal; the first controlling terminal and the second controlling terminal are connected to the first controlling line and the second controlling line, respectively; the first outputting terminal and the second outputting terminal are connected to the first sub-data line and the second sub-data line, respectively; the first inputting terminal and the second inputting terminal both are connected to the data line.

According an embodiment of the present disclosure, at a first predetermined time, the first controlling line is configured to turn on the first controlling switch with the first controlling signal; the second controlling line is configured to turn off the second controlling switch with the second controlling signal; the first scanning line is configured to turn on both of the first pixel switch and the second pixel switch with the first scanning signal; the second scanning line is configured to turn off both of the third pixel switch and the fourth pixel switch with the second scanning signal; the data line is configured to input the transmitted data signal into the first subpixel.

According an embodiment of the present disclosure, at a second predetermined time, the first controlling line is configured to turn off the first controlling switch with the first controlling signal; the second controlling line is configured to turn on the second controlling switch with the second controlling signal; the first scanning line is configured to keep both of the first pixel switch and the second pixel switch turning on with the first scanning signal; the second scanning line is configured to keep both of the third pixel switch and the fourth pixel switch turning off with the second scanning signal; the data line is configured to input the transmitted data signal into the second subpixel.

According an embodiment of the present disclosure, at a third predetermined time, the first controlling line is configured to keep the first controlling switch turning off with the first controlling signal; the second controlling line is configured to keep the second controlling switch turning off with the second controlling signal; the first scanning line is configured to turn off both of the first pixel switch and the second pixel switch with the first scanning signal; the second scanning line is configured to turn on both of the third pixel switch and the fourth pixel switch with the second scanning signal; the data line is configured to input the transmitted data signal into the fourth subpixel.

According an embodiment of the present disclosure, at a fourth predetermined time, the first controlling line is configured to turn on the first controlling switch with the first controlling signal; the second controlling line is configured to turn off the second controlling switch with the second controlling signal; the first scanning line is configured to keep both of the first pixel switch and the second pixel switch turning off with the first scanning signal; the second scanning line is configured to keep both of the third pixel switch and the fourth pixel switch turning on with the second scanning signal; the data line is configured to input the transmitted data signal into the third subpixel.

According an embodiment of the present disclosure, the color corresponding to the first subpixel is either red or blue but different from the color corresponding to the third subpixel; the color corresponding to the third subpixel is either red or blue but different from the color corresponding to the first subpixel; the second subpixel and the fourth subpixel both are green.

According to a third aspect of the present disclosure, a method of driving the display panel includes: (A) controlling the data signal to be input into the first subpixel at the first determined time; (B) controlling the data signal to be input into the second subpixel at the second determined time; (C) controlling the data signal to be input into the fourth subpixel at the third determined time; and (D) controlling the data signal to be input into the third subpixel at the fourth determined time.

According an embodiment of the present disclosure, the step A comprises: (a1) controlling the first controlling switch to be turned on with the first controlling signal through the first controlling line of the demultiplexing circuit; (a2) controlling the second controlling switch to be turned off with the second controlling signal through the second controlling line of the demultiplexing circuit; (a3) turning on the first pixel switch of the first subpixel and the second pixel switch of the second subpixel with the first scanning signal through the first scanning line; (a4) turning off the third pixel switch of the third subpixel and the fourth pixel switch of the fourth subpixel with the second scanning signal through the second scanning line; and (a5) inputting the transmitted data signal into the first subpixel through the data line.

According an embodiment of the present disclosure, the step B comprises: (b1) controlling the first controlling switch to be turned off with the first controlling signal through the first controlling line of the demultiplexing circuit; (b2) controlling the second controlling switch to be turned on with the second controlling signal through the second controlling line of the demultiplexing circuit; (b3) keeping both of the first pixel switch of the first subpixel and the second pixel switch of the second subpixel turning on with the first scanning signal through the first scanning line; (b4) keeping both of the third pixel switch of the third subpixel and the fourth pixel switch of the fourth subpixel turning off with the second scanning signal through the second scanning line; and (b5) inputting the transmitted data signal into the second subpixel through the data line.

According an embodiment of the present disclosure, the step C comprises: (c1) keeping the first controlling switch turning off with the first controlling signal through the first controlling line of the demultiplexing circuit; (c2) keeping the second controlling switch turning on with the second controlling signal turned on through the second controlling line of the demultiplexing circuit; (c3) keeping both of the first pixel switch of the first subpixel and the second pixel switch of the second subpixel turning off with the first scanning signal through the first scanning line; (c4) keeping the third pixel switch of the third subpixel and the fourth pixel switch of the fourth subpixel turning on with the second scanning signal through the second scanning line; and (c5) inputting the transmitted data signal into the fourth subpixel through the data line.

According an embodiment of the present disclosure, the step D comprises: (d1) controlling the first controlling switch to be turned on with the first controlling signal through the first controlling line of the demultiplexing circuit; (d2) controlling the second controlling switch to be turned off with the second controlling signal through the second controlling line of the demultiplexing circuit; (d3) keeping the first pixel switch of the first subpixel and the second pixel switch of the second subpixel turning off with the first scanning signal through the first scanning line; (d4) keeping the third pixel switch of the third subpixel and the fourth pixel switch of the fourth subpixel turning on with the second scanning signal through the second scanning line; and (d5) inputting the transmitted data signal into the third subpixel through the data line.

In the present disclosure, a scanning driving circuit and a demultiplexing circuit both control to input a data signal into a first subpixel, a second subpixel, a fourth subpixel, and a third subpixel sequentially through a data line. On the contrary, it is necessary to use a demultiplexing circuit controlled by a controlling signal with higher frequency in the related art where a data signal is input into a first subpixel, a second subpixel, a third subpixel, and a fourth subpixel sequentially. Different from the related art, according to the technical solution proposed by the present disclosure, the frequencies of the controlling signals (i.e., the first controlling signal and the second controlling signal) which control the demultiplexing circuit are lowered, thereby reducing power consumption of the display panel.

These and other features, aspects and advantages of the present disclosure will become understood with reference to the following description, appended claims and accompanying figures.

BRIEF DESCRIPTION OF THE SEVERAL VIEW OF THE DRAWINGS

DESCRIPTION OF SPECIFIC EMBODIMENTS OF THE INVENTION

In the description of this specification, the description of the terms "one embodiment", "some embodiments", "examples", "specific examples", or "some examples", and the like, means to refer to the specific feature, structure, material or characteristic described in connection with the embodiments or examples being included in at least one embodiment or example of the present disclosure.

Figure 1:
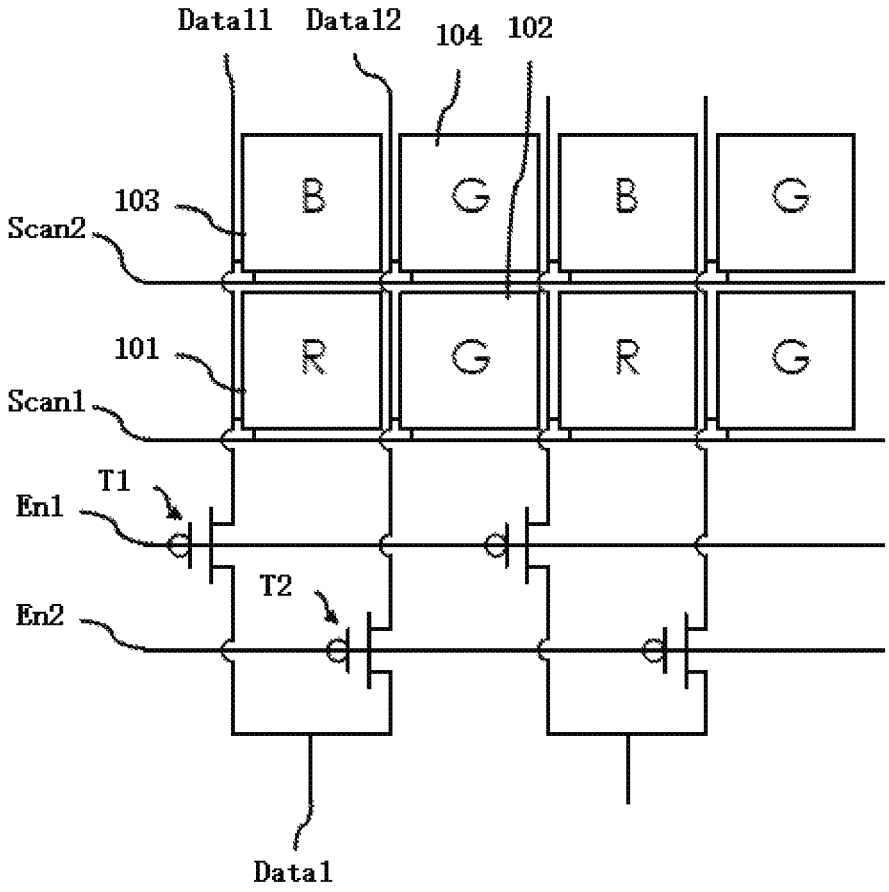
FIG. 1 is a schematic diagram of a display panel according to an embodiment of the present disclosure.
Figure 2:
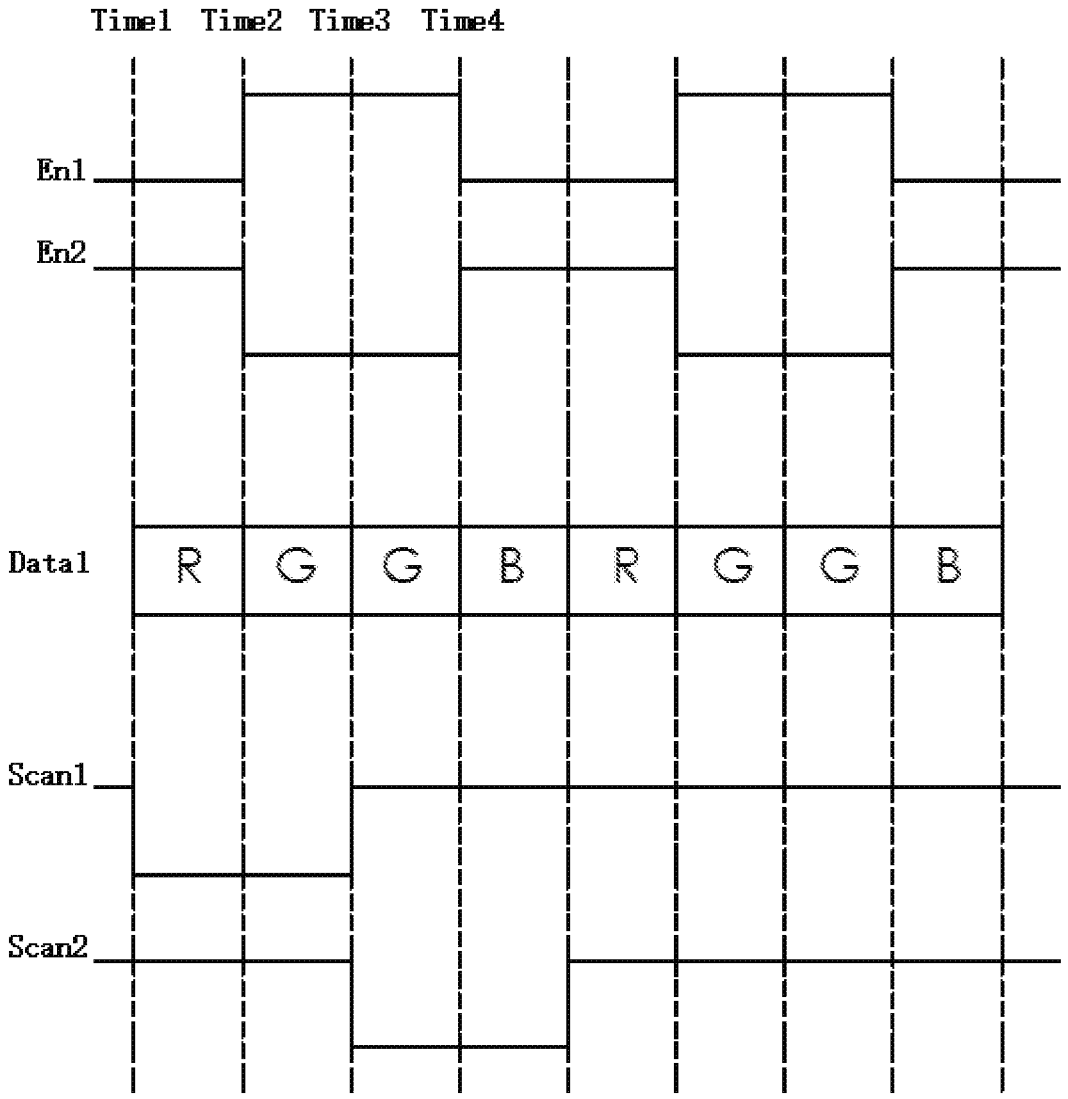
FIG. 2 is a waveform chart of a scanning signal, a data signal, and a controlling signal in the display panel according to the embodiment of the present disclosure.

Please refer to FIG. 1 and FIG. 2. FIG. 1 is a schematic diagram of a display panel according to an embodiment of the present disclosure. FIG. 2 is a waveform chart of a scanning signal, a data signal, and a controlling signal in the display panel according to the embodiment of the present disclosure.

The display panel of the present disclosure may be a thin film transistor liquid crystal display (TFT-LCD), an organic light emitting diode (OLED) or the like.

The display panel of the present disclosure includes a pixel array, a data driving circuit, a scanning driving circuit, and a demultiplexing circuit. The scanning driving circuit is connected to the pixel array. The demultiplexing circuit is connected to the pixel array. The data driving circuit is connected to the demultiplexing circuit.

The pixel array includes one or more first pixel row and second pixel row. The first pixel row includes one or more first subpixel 101 and second subpixel 102. The second pixel row includes one or more third subpixel 103 and fourth subpixel 104. The first subpixel 101 and the third subpixel 103 both are in a first pixel column. The second subpixel 102 and the fourth subpixel 104 both are in a second pixel column. That is to say, the first subpixel 101, the second subpixel 102, the third subpixel 103, and the fourth subpixel 104 are arranged in a two-dimensional (2D) array.

The color corresponding to the second subpixel 102 is the same as the color corresponding to the fourth subpixel 104.

The color corresponding to the first subpixel, the color corresponding to the second subpixel, and the color corresponding to the third subpixel are red, green, or blue arbitrarily, but the three colors are different from one another. For example, the color corresponding to the first subpixel 101 is either red or blue but different from the color corresponding to the third subpixel 103, and the color corresponding to the third subpixel 103 is either red or blue but different from the color corresponding to the first subpixel 101. The color corresponding to the second subpixel 102 and the color corresponding to the fourth subpixel 104 both are green.

The data driving circuit includes one or more data line Data1, first sub-data line Data11, and second sub-data line Data12.

The scanning driving circuit includes one or more first scanning line Scan1 and second scanning line Scan2.

The demultiplexing circuit is connected to the data line Data1, the first sub-data line Data11, and the second sub-data line Data12.

The scanning driving circuit and the demultiplexing circuit both are configured to input the data signal into the first subpixel 101, the second subpixel 102, the fourth subpixel 104, and the third subpixel 103 sequentially through the data line Data1.

The first subpixel 101, the second subpixel 102, the fourth subpixel 104, and the third subpixel 103 show red, green, green, and blue sequentially, or show blue, green, green, and red sequentially.

The first sub-data line Data11 and the second sub-data line Data12 are connected to the first pixel column and the second pixel column, respectively. The demultiplexing circuit is configured to turn on and off a first current channel between the data line Data1 and the first sub-data line Data11 and control to turn on and off a second current channel between the data line Data1 and the second sub-data line Data12.

The first scanning line Scan1 is connected to the first subpixel 101 and the second subpixel 102. The second scanning line Scan2 is connected to the third subpixel 103 and the fourth subpixel 104. The scanning driving circuit is configured to turn on and off a first pixel switch of the first subpixel 101 and a second pixel switch of the second subpixel 102 and control to turn on and off a third pixel switch of the third subpixel 103 and a fourth pixel switch of the fourth subpixel 104.

The demultiplexing circuit includes one or more first controlling switch T1, second controlling switch T2, first controlling line En1, and second controlling line En2. When the first controlling switch T1 is turned on, the second controlling switch T2 is turned off. While the first controlling switch T1 is turned off, the second controlling switch T2 is turned on.

The first controlling switch T1 and the second controlling switch T2 both are transistors. The first controlling switch T1 and the second controlling switch T2 are disposed on one side of the pixel array.

The first controlling line En1 is connected to the first controlling switch T1. The second controlling line En2 is connected to the second controlling switch T2.

The first sub-data line Data11 and the second sub-data line Data12 are connected to the data line Data1 through the first controlling switch T1 and the second controlling switch T2, respectively.

The first pixel switch of the first subpixel 101 and the second pixel switch of the second subpixel 102 are simultaneously turned on and off. The third pixel switch of the third subpixel 103 and the fourth pixel switch of the fourth subpixel 104 are simultaneously turned on and off.

When the first pixel switch is turned on, the third pixel switch is turned off. When the first pixel switch is turned off, the third pixel switch is turned on. The time when the first pixel switch is turned on is separated from the time when the third pixel switch is turned on by a first time interval. The time when the first pixel switch is turned off is separated from the time when the third pixel switch is turned off by a second time interval.

When the second pixel switch is turned on, the fourth pixel switch is turned off. When the second pixel switch is turned off, the fourth pixel switch is turned on. The time when the second pixel switch is turned on is separated from the time when the fourth pixel switch is turned on by a third time interval. The time when the second pixel switch is turned off is separated from the time when the fourth pixel switch is turned off by a fourth time interval.

The first time interval, the second time interval, the third time interval, and the fourth time interval are all equal.

The first controlling switch T1 includes a first inputting terminal, a first outputting terminal, and a first controlling terminal. The second controlling switch T2 includes a second inputting terminal, a second outputting terminal, and a second controlling terminal. The first controlling terminal and the second controlling terminal are connected to the first controlling line En1 and the second controlling line En2, respectively. The first controlling terminal and the second controlling terminal are connected to the first controlling line En1 and the second controlling line En2, respectively. The first inputting terminal and the second inputting terminal both are connected to the data line Data1.

The first controlling switch T1 is configured to turn on and off the first current channel between the data line Data1 and the first sub-data line Data11. The second controlling switch T2 is configured to turn on and off the second current channel between the data line Data1 and the second sub-data line Data12.

At a first predetermined time Time1, the first controlling line En1 is configured to turn on the first controlling switch T1 with a first controlling signal. The second controlling line En2 is configured to turn off the second controlling switch T2 with a second controlling signal. The first scanning line Scan1 is configured to turn on both of the first pixel switch and the second pixel switch with the first scanning signal. The second scanning line Scan2 is configured to turn off both of the third pixel switch and the fourth pixel switch with the second scanning signal. The data line Data1 is configured to input the transmitted data signal into the first subpixel 101.

At a first predetermined time Time1, the first controlling signal is at a low voltage level, and the first controlling switch T1 (the first controlling switch T1 is a transistor including an NOT gate) is turned on. The second controlling signal is at a high voltage level, and the second controlling switch T2 (the second controlling switch T2 is a transistor including an NOT gate) is turned off. The first scanning signal is at a low voltage level. The first pixel switch and the second pixel switch both are turned on. The second scanning signal is at a high voltage level, and the third pixel switch and the fourth pixel both are turned off. At this time, the data signal transmitted through the data line Data1 is input into the first subpixel 101 through the first sub-data line Data11.

At a second predetermined time Time2, the first controlling line En1 is configured to turn off the first controlling switch T1 with the first controlling signal. The second controlling line En2 is configured to turn on the second controlling switch T2 with the second controlling signal. The first scanning line Scan1 is configured to keep both of the first pixel switch and the second pixel switch turned on with the first scanning signal. The second scanning line Scan2 is configured to keep both of the third pixel switch and the fourth pixel switch turned off with the second scanning signal. The data line Data1 is configured to input the transmitted data signal into the second subpixel 102.

At the second predetermined time Time2, the first controlling signal is at a high voltage level, and the first controlling switch T1 is turned off. The second controlling signal is at a low voltage level, and the second controlling switch T2 is turned on. The first scanning signal is at a low voltage level, the first pixel switch and the second pixel switch both are turned on. The second scanning signal is at a high voltage level, and the third pixel switch and the fourth pixel switch both are turned off. At this time, the data signal transmitted through the data line Data1 is input into the second subpixel 102 through the second sub-data line Data12.

At a third predetermined time Time3, the first controlling line En1 is configured to keep the first controlling switch T1 turned off with the first controlling signal. The second controlling line En2 is configured to keep the second controlling switch T2 turned on with the second controlling signal. The first scanning line Scan1 is configured to turn off both the first pixel switch and the second pixel switch with the first scanning signal. The second scanning line Scan2 is configured to turn on both of the third pixel switch and the fourth pixel switch with the second scanning signal. The data line Data1 is configured to input the transmitted data signal into the fourth subpixel 104.

Specifically, at the third predetermined time Time3, the first controlling signal is at a high voltage level, and the first controlling switch T1 is turned off. The second controlling signal is at a low voltage level. The second controlling switch T2 is turned on. The first scanning signal is at a high voltage level. The first pixel switch and the second pixel switch both are turned off. The second scanning signal is at a low voltage level. The third pixel switch and the fourth pixel both are turned on. At this time, the data signal transmitted through the data line Data1 is input into the fourth subpixel 104 through the second sub-data line Data12.

At a fourth predetermined time Time4, the first controlling line En1 is configured to turn on the first controlling switch T1 with the first controlling signal. The second controlling line En2 is configured to turn off the second controlling switch T2 with the second controlling signal. The first scanning line Scan1 is configured to keep the first pixel switch and the second pixel switch turned off with the first scanning signal. The second scanning line Scan2 is configured to keep the third pixel switch and the fourth pixel switch with the second scanning signal. The data line Data1 is configured to input the transmitted data signal into the third subpixel 103.

At the fourth predetermined time Time4, the first controlling signal is at a low voltage level, and the first controlling switch T1 is turned on. The second controlling signal is at a high voltage level. The second controlling switch T2 is turned off. The first scanning signal is at a high voltage level. The first pixel switch and the second pixel switch both are turned off. The second scanning signal is at a low voltage level, and the third pixel switch and the fourth pixel switch both are turned on. At this time, the data signal transmitted through the data line Data1 is input into the third subpixel 103 through the first sub-data line Data11.

Figure 3:
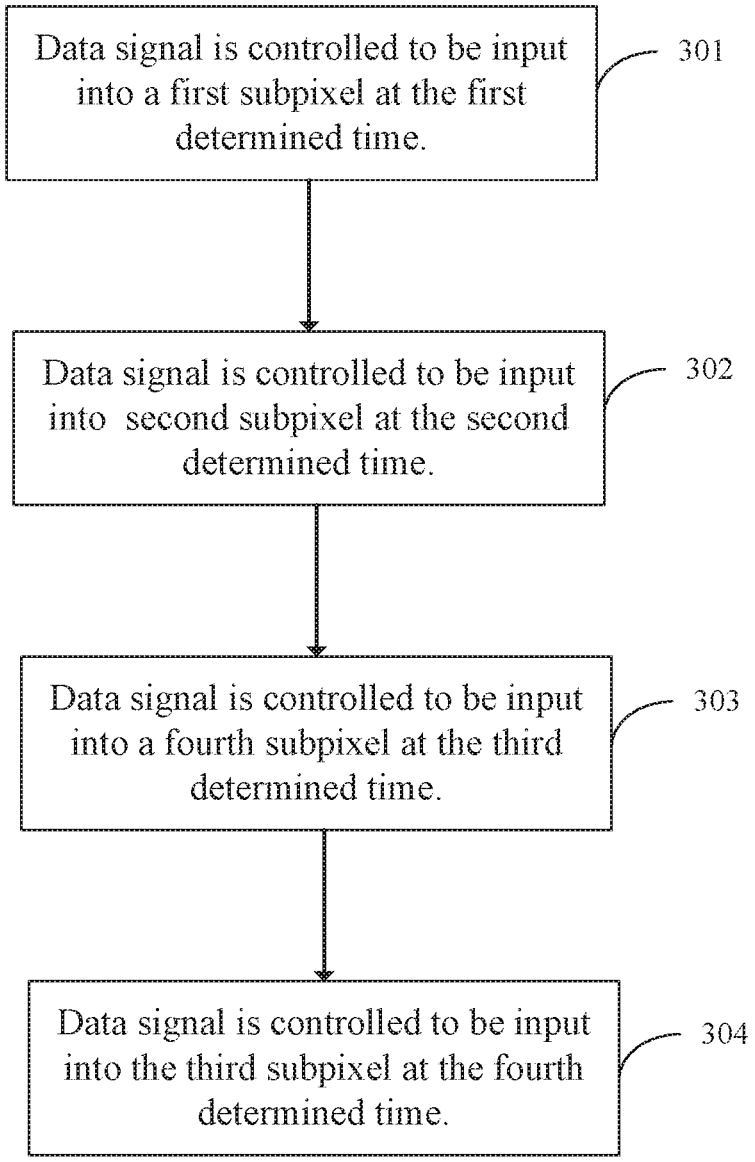
FIG. 3 is a flowchart of a method of driving the display panel according to another embodiment of the present disclosure.

FIG. 3 is a flowchart of a method of driving the display panel according to another embodiment of the present disclosure.

The method includes block A (block 301), block B (block 302), block C (block 303), and block D (block 304).

At block A (block 301), the data signal is controlled to be input into the first subpixel 101 at the first determined time Time1.

At block B (block 302), the data signal is controlled to be input into the second subpixel 102 at the second determined time Time2.

At block C (block 303), the data signal is controlled to be input into the fourth subpixel 104 at the third determined time Time3.

At block D (block 304), the data signal is controlled to be input into the third subpixel 103 at the fourth determined time Time4.

The block A includes block a1, block a2, block a3, block a4, and block a5.

At block a1, the first controlling switch T1 is controlled to be turned on with the first controlling signal through the first controlling line En1 of the demultiplexing circuit.

At block a2, the second controlling switch T2 is controlled to be turned off with the second controlling signal through the second controlling line En2 of the demultiplexing circuit.

At block a3, the first pixel switch of the first subpixel 101 and the second pixel switch of the second subpixel 102 both are controlled to be turned on with the first scanning signal through the first scanning line Scan1.

At block a4, the third pixel switch of the third subpixel 103 and the fourth pixel switch of the fourth subpixel 104 are controlled to be turned off with the second scanning signal through the second scanning line Scan2.

At block a5, the transmitted data signal is input into the first subpixel 101 through the data line Data1.

Block a1, block a2, block a3, and block a4 are in no particular order, that is, block a1, block a2, block a3, and block a4 may be performed in any order or may be performed simultaneously.

At the first predetermined time Time1, the first controlling signal is at a low voltage level, and the first controlling switch T1 (the first controlling switch T1 is a transistor including an NOT gate) is turned on. The second controlling signal is at a high voltage level. The second controlling switch T2 (the second controlling switch T2 is a transistor including an NOT gate) is turned off. The first scanning signal is at a low voltage level. The first pixel switch and the second pixel switch both are turned on. The second scanning signal is at a high voltage level. The third pixel switch and the fourth pixel switch both are turned off. At this time, the data signal transmitted through the data line Data1 is input into the first subpixel 101 through the first sub-data line Data11.

The block B includes block b1, block b2, block b3, block b4, and block b5.

At block b1, the first controlling switch T1 is controlled to be turned off with the first controlling signal through the first controlling line En1 of the demultiplexing circuit.

At block b2, the second controlling switch T2 is controlled to be turned on with the second controlling signal through the second controlling line En2 of the demultiplexing circuit.

At block b3, both of the first pixel switch of the first subpixel 101 and the second pixel switch of the second subpixel 102 keep turned on with the first scanning signal through the first scanning line Scan1.

At block b4, At block b4, both of the third pixel switch of the third subpixel 103 and the fourth pixel switch of the fourth subpixel 104 keep turned off with the second scanning signal through the second scanning line Scan2.

At block b5, the transmitted data signal is input into the second subpixel 102 through the data line Data1.

Block b1, block b2, block b3, and block b4 are in no particular order, that is, block b1, block b2, block b3, and block b4 may be performed in any order or may be performed simultaneously.

Specifically, at the second predetermined time Time2, the first controlling signal is at a high voltage level, and the first controlling switch T1 is turned off. The second controlling signal is at a low voltage level. The second controlling switch T2 is turned on. The first scanning signal is at a low voltage level. The first pixel switch and the second pixel switch both are turned on. The second scanning signal is at a high voltage level. The third pixel switch and the fourth pixel both are turned off. At this time, the data signal transmitted through the data line Data1 is input into the second subpixel 102 through the second sub-data line Data12.

The block C includes block c1, block c2, block c3, block c4, and block c5.

At block c1, the first controlling switch T1 keeps turned off with the first controlling signal through the first controlling line En1 of the demultiplexing circuit.

At block c2, the second controlling switch T2 keeps turned on with the second controlling signal turned on through the second controlling line En2 of the demultiplexing circuit.

At block c3, both of the first pixel switch of the first subpixel 101 and the second pixel switch of the second subpixel 102 keep turned off with the first scanning signal through the first scanning line Scan1.

At block c4, the third pixel switch of the third subpixel 103 and the fourth pixel switch of the fourth subpixel 104 keep turned on with the second scanning signal through the second scanning line Scan2.

At block c5, the transmitted data signal is into the fourth subpixel 104 through the data line Data1.

Block c1, block c2, block c3, and block c4 are in no particular order, that is, block c1, block c2, block c3, and block c4 may be performed in any order or may be performed simultaneously.

At a third predetermined time Time3, the first controlling signal is at a high voltage level, and the first controlling switch T1 is turned off. The second controlling signal is at a low voltage level. The second controlling switch T2 is turned on. The first scanning signal is at a high voltage level. The first pixel switch and the second pixel switch both are turned off. The second scanning signal is at a low voltage level. The third pixel switch and the fourth pixel both are turned on. At this time, the data signal transmitted through the data line Data1 is input into the fourth subpixel 104 through the second sub-data line Data12.

The block D includes block d1, block d2, block d3, block d4, and block d5.

At block d1, the first controlling switch T1 is controlled to be turned on with the first controlling signal through the first controlling line En1 of the demultiplexing circuit.

At block d2, the second controlling switch T2 is controlled to be turned off with the second controlling signal through the second controlling line En2 of the demultiplexing circuit.

At block d3, the first pixel switch of the first subpixel 101 and the second pixel switch of the second subpixel 102 keep turned off with the first scanning signal through the first scanning line Scan1.

At block d4, the third pixel switch of the third subpixel 103 and the fourth pixel switch of the fourth subpixel 104 keep turned on with the second scanning signal through the second scanning line Scan2.

At block d5, the transmitted data signal is input into the third subpixel 103 through the data line Data1.

Block d1, block d2, block d3, and block d4 are in no particular order, that is, block d1, block d2, block d3, and block d4 may be performed in any order or may be performed simultaneously.

At the fourth predetermined time Time4, the first controlling signal is at a low voltage level, and the first controlling switch T1 is turned on. The second controlling signal is at a high voltage level. The second controlling switch T2 is turned off. The first scanning signal is at a high voltage level. The first pixel switch and the second pixel switch both are turned off. The second scanning signal is at a low voltage level, and the third pixel switch and the fourth pixel switch both are turned on. At this time, the data signal transmitted through the data line Data1 is input into the third subpixel 103 through the first sub-data line Data11.

In the present disclosure, the scanning driving circuit and the demultiplexing circuit both control to input the data signal into the first subpixel 101, the second subpixel 102, the fourth subpixel 104, and the third subpixel 103 sequentially through the data line Data1. On the contrary, it is necessary to use a demultiplexing circuit controlled by a controlling signal with higher frequency in the related art where the data signal is input into the first subpixel 101, the second subpixel 102, the third subpixel 103, and the fourth subpixel 104 sequentially. Different from the related art, according to the technical solution proposed by the present disclosure, the frequencies of the controlling signals (i.e., the first controlling signal and the second controlling signal) which control the demultiplexing circuit are lowered, thereby reducing power consumption of the display panel.

What is claimed is:

1. A display panel, comprising:

a pixel array, comprising a first pixel row and a second pixel row; the first pixel row comprising one or more a first subpixel and a second subpixel; the second pixel row comprising one or more a third subpixel and a fourth subpixel; the first subpixel and the third subpixel both being in a first pixel column; the second subpixel and the fourth subpixel both being in a second pixel column; color corresponding to the second subpixel being the same as the color corresponding to the fourth subpixel;

a data driving circuit, comprising one or more data line;

a scanning driving circuit;

a demultiplexing circuit;

wherein the scanning driving circuit and the demultiplexing circuit both are configured to input a data signal through the data line into the first subpixel, the second subpixel, the fourth subpixel, and the third subpixel sequentially, wherein a first pixel switch of the first subpixel and a second pixel switch of the second subpixel are turned on or off simultaneously; a third pixel switch of the third subpixel and a fourth pixel switch of the fourth subpixel are turned on or off simultaneously;

when the first pixel switch is turned on, the third pixel switch is turned off; when the first pixel switch is turned off, the third pixel switch is turned on;

when the second pixel switch is turned on, the fourth pixel switch is turned off;

when the second pixel switch is turned off, the fourth pixel switch is turned on, wherein the color corresponding to the first subpixel is either red or blue but different from the color corresponding to the third subpixel; the color corresponding to the third subpixel is either red or blue but different from the color corresponding to the first subpixel; the second subpixel and the fourth subpixel both are green.

2. The display panel of claim 1, wherein the time when the first pixel switch is turned on is separated from the time when the third pixel switch is turned on by a first time interval; the time when the first pixel switch is turned off is separated from the time when the third pixel switch is turned off by a second time interval; the time when the second pixel switch is turned on is separated from the time when the fourth pixel switch is turned on by a third time interval; the time when the second pixel switch is turned off is separated from the time when the fourth pixel switch is turned off by a fourth time interval;

the first time interval, the second time interval, the third time interval, and the fourth time interval are all equal.

3. The display panel of claim 1, wherein the data driving circuit further comprises a first sub-data line and a second sub-data line;

the scanning driving circuit comprises one or more first scanning line and second scanning line;

the demultiplexing circuit is connected to the data line, the first sub-data line, and the second sub-data line; the demultiplexing circuit comprises one or more first controlling switch, second controlling switch, first controlling line, and second controlling line; when the first controlling switch is turned on, the second controlling switch is turned off; when the first controlling switch is turned off, the second controlling switch is turned on.

4. A display panel, comprising:

a pixel array, comprising a first pixel row and a second pixel row; the first pixel row comprising one or more a first subpixel and a second subpixel; the second pixel row comprising one or more a third subpixel and a fourth subpixel; the first subpixel and the third subpixel both being in a first pixel column; the second subpixel and the fourth subpixel both being in a second pixel column; color corresponding to the second subpixel being the same as the color corresponding to the fourth subpixel;

a data driving circuit, comprising one or more data line;

a scanning driving circuit;

a demultiplexing circuit;

wherein the scanning driving circuit and the demultiplexing circuit both are configured to input a data signal through the data line into the first subpixel, the second subpixel, the fourth subpixel, and the third subpixel sequentially, wherein a first pixel switch of the first subpixel and a second pixel switch of the second subpixel are turned on or off simultaneously; a third pixel switch of the third subpixel and a fourth pixel switch of the fourth subpixel are turned on or off simultaneously;

when the first pixel switch is turned on, the third pixel switch is turned off; when the first pixel switch is turned off, the third pixel switch is turned on;

when the second pixel switch is turned on, the fourth pixel switch is turned off; when the second pixel switch is turned off, the fourth pixel switch is turned on.

5. The display panel of claim 4, wherein the time when the first pixel switch is turned on is separated from the time when the third pixel switch is turned on by a first time interval; the time when the first pixel switch is turned off is separated from the time when the third pixel switch is turned off by a second time interval; the time when the second pixel switch is turned on is separated from the time when the fourth pixel switch is turned on by a third time interval; the time when the second pixel switch is turned off is separated from the time when the fourth pixel switch is turned off by a fourth time interval;

the first time interval, the second time interval, the third time interval, and the fourth time interval are all equal.

6. The display panel of claim 4, wherein the data driving circuit further comprises a first sub-data line and a second sub-data line;

the scanning driving circuit comprises one or more first scanning line and second scanning line;

the demultiplexing circuit is connected to the data line, the first sub-data line, and the second sub-data line; the demultiplexing circuit comprises one or more first controlling switch, second controlling switch, first controlling line, and second controlling line; when the first controlling switch is turned on, the second controlling switch is turned off; when the first controlling switch is turned off, the second controlling switch is turned on.

7. The display panel of claim 6, wherein the first controlling switch and the second controlling switch both are transistors;

the first controlling switch and the second controlling switch are disposed on one side of the pixel array.

8. The display panel of claim 6, wherein the first sub-data line and the second sub-data line are connected to the first pixel column and the second pixel column, respectively;

the demultiplexing circuit is configured to turn on or off a first current channel between the data line and the first sub-data line, and control to turn on or off a second current channel between the data line and the second sub-data line.

9. The display panel of claim 6, wherein the first controlling switch comprises a first inputting terminal, a first outputting terminal, and a first controlling terminal; the second controlling switch comprises a second inputting terminal, a second outputting terminal, and a second controlling terminal; the first controlling terminal and the second controlling terminal are connected to the first controlling line and the second controlling line, respectively; the first outputting terminal and the second outputting terminal are connected to the first sub-data line and the second sub-data line, respectively; the first inputting terminal and the second inputting terminal both are connected to the data line.

10. The display panel of claim 6, wherein at a first predetermined time, the first controlling line is configured to turn on the first controlling switch with the first controlling signal; the second controlling line is configured to turn off the second controlling switch with the second controlling signal; the first scanning line is configured to turn on both of the first pixel switch and the second pixel switch with the first scanning signal; the second scanning line is configured to turn off both of the third pixel switch and the fourth pixel switch with the second scanning signal; the data line is configured to input the transmitted data signal into the first subpixel.

11. The display panel of claim 6, wherein at a second predetermined time, the first controlling line is configured to turn off the first controlling switch with the first controlling signal; the second controlling line is configured to turn on the second controlling switch with the second controlling signal; the first scanning line is configured to keep both of the first pixel switch and the second pixel switch turning on with the first scanning signal; the second scanning line is configured to keep both of the third pixel switch and the fourth pixel switch turning off with the second scanning signal; the data line is configured to input the transmitted data signal into the second subpixel.

12. The display panel of claim 6, wherein at a third predetermined time, the first controlling line is configured to keep the first controlling switch turning off with the first controlling signal; the second controlling line is configured to keep the second controlling switch turning off with the second controlling signal; the first scanning line is configured to turn off both of the first pixel switch and the second pixel switch with the first scanning signal; the second scanning line is configured to turn on both of the third pixel switch and the fourth pixel switch with the second scanning signal; the data line is configured to input the transmitted data signal into the fourth subpixel.

13. The display panel of claim 6, wherein at a fourth predetermined time, the first controlling line is configured to turn on the first controlling switch with the first controlling signal; the second controlling line is configured to turn off the second controlling switch with the second controlling signal; the first scanning line is configured to keep both of the first pixel switch and the second pixel switch turning off with the first scanning signal; the second scanning line is configured to keep both of the third pixel switch and the fourth pixel switch turning on with the second scanning signal; the data line is configured to input the transmitted data signal into the third subpixel.

14. The display panel of claim 4, wherein the color corresponding to the first subpixel is either red or blue but different from the color corresponding to the third subpixel; the color corresponding to the third subpixel is either red or blue but different from the color corresponding to the first subpixel; the second subpixel and the fourth subpixel both are green.

15. A method of driving the display panel as claimed in claim 4, comprising:

(A) controlling the data signal to be input into the first subpixel at a first determined time;

(B) controlling the data signal to be input into the second subpixel at a second determined time;

(C) controlling the data signal to be input into the fourth subpixel at a third determined time; and (D) controlling the data signal to be input into the third subpixel at a fourth determined time, wherein the step A comprises:

(a1) controlling the first controlling switch to be turned on with the first controlling signal through the first controlling line of the demultiplexing circuit;

(a2) controlling the second controlling switch to be turned off with the second controlling signal through the second controlling line of the demultiplexing circuit;

(a3) turning on the first pixel switch of the first subpixel and the second pixel switch of the second subpixel with the first scanning signal through the first scanning line;

(a4) turning off the third pixel switch of the third subpixel and the fourth pixel switch of the fourth subpixel with the second scanning signal through the second scanning line; and (a5) inputting the transmitted data signal into the first subpixel through the data line.

16. The method of claim 15, wherein the step B comprises:

(b1) controlling the first controlling switch to be turned off with the first controlling signal through the first controlling line of the demultiplexing circuit;

(b2) controlling the second controlling switch to be turned on with the second controlling signal through the second controlling line of the demultiplexing circuit;

(b3) keeping both of the first pixel switch of the first subpixel and the second pixel switch of the second subpixel turning on with the first scanning signal through the first scanning line;

(b4) keeping both of the third pixel switch of the third subpixel and the fourth pixel switch of the fourth subpixel turning off with the second scanning signal through the second scanning line; and (b5) inputting the transmitted data signal into the second subpixel through the data line.

17. The method of claim 15, wherein the step C comprises:

(c1) keeping the first controlling switch turning off with the first controlling signal through the first controlling line of the demultiplexing circuit;

(c2) keeping the second controlling switch turning on with the second controlling signal turned on through the second controlling line of the demultiplexing circuit;

(c3) keeping both of the first pixel switch of the first subpixel and the second pixel switch of the second subpixel turning off with the first scanning signal through the first scanning line;

(c4) keeping the third pixel switch of the third subpixel and the fourth pixel switch of the fourth subpixel turning on with the second scanning signal through the second scanning line; and (c5) inputting the transmitted data signal into the fourth subpixel through the data line.

18. The method of claim 15, wherein the step D comprises:

(d1) controlling the first controlling switch to be turned on with the first controlling signal through the first controlling line of the demultiplexing circuit;

(d2) controlling the second controlling switch to be turned off with the second controlling signal through the second controlling line of the demultiplexing circuit;

(d3) keeping the first pixel switch of the first subpixel and the second pixel switch of the second subpixel turning off with the first scanning signal through the first scanning line;

(d4) keeping the third pixel switch of the third subpixel and the fourth pixel switch of the fourth subpixel turning on with the second scanning signal through the second scanning line; and (d5) inputting the transmitted data signal into the third subpixel through the data line.

* * * * *